US010669859B2

(12) United States Patent
Batt

(10) Patent No.: US 10,669,859 B2
(45) Date of Patent: Jun. 2, 2020

(54) TURBINE STATOR VANE AND/OR TURBINE ROTOR VANE WITH A COOLING FLOW ADJUSTMENT FEATURE AND CORRESPONDING METHOD OF ADAPTING A VANE

(71) Applicant: Siemens Aktiengesellschaft, Munich (DE)

(72) Inventor: Stephen Batt, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 62 days.

(21) Appl. No.: 15/739,273

(22) PCT Filed: Jul. 6, 2016

(86) PCT No.: PCT/EP2016/065954

§ 371 (c)(1),
(2) Date: Dec. 22, 2017

(87) PCT Pub. No.: WO2017/005781

PCT Pub. Date: Jan. 12, 2017

(65) Prior Publication Data

US 2018/0179897 A1 Jun. 28, 2018

(30) Foreign Application Priority Data

Jul. 6, 2015 (EP) ..... 15175475

(51) Int. Cl.
*F01D 5/18* (2006.01)
*F01D 9/06* (2006.01)
(Continued)

(52) U.S. Cl.
CPC ..... *F01D 5/18* (2013.01); *F01D 9/041* (2013.01); *F01D 9/06* (2013.01); *F01D 25/12* (2013.01);
(Continued)

(58) Field of Classification Search
CPC . F01D 5/18; F01D 5/10; F01D 5/1869; F01D 9/06; F01D 25/12; F05D 2230/10;
(Continued)

(56) References Cited

U.S. PATENT DOCUMENTS 5,022,817 A 6/1991 O'Halloran
5,403,156 A * 4/1995 Arness ..... F01D 5/081 29/889.21
(Continued)

FOREIGN PATENT DOCUMENTS

DE 202011109225 U1 3/2012
EP 1361337 A1 11/2003
(Continued)

OTHER PUBLICATIONS

"P.W. Schilke, Advanced Gas Turbine Materials and Coatings, Year: 2004, General Electric Company, pp. 1, 3, and 9" (Year: 2004).*
(Continued)

*Primary Examiner* — Ninh H. Nguyen
*Assistant Examiner* — Behnoush Haghighian
(74) *Attorney, Agent, or Firm* — Beusse Wolter Sanks & Maire

(57) ABSTRACT

A turbine stator vane or turbine rotor vane has a body, a channel being adapted for leading a cooling fluid through the body, and a flow adaption feature protruding from the body to the channel in such a manner as to reduce a cross-sectional area of the channel.

13 Claims, 4 Drawing Sheets

(51) Int. Cl.
*F01D 9/04* (2006.01)
*F01D 25/12* (2006.01)
*F01D 5/10* (2006.01)

(52) U.S. Cl.
CPC ..... *F01D 5/10* (2013.01); *F05D 2230/10* (2013.01); *F05D 2230/21* (2013.01); *F05D 2230/22* (2013.01); *F05D 2230/30* (2013.01); *F05D 2240/12* (2013.01); *F05D 2250/512* (2013.01); *F05D 2260/20* (2013.01); *F05D 2260/83* (2013.01)

(58) Field of Classification Search
CPC ..... F05D 2230/21; F05D 2230/22; F05D 2230/30; F05D 2240/12; F05D 2250/512; F05D 2260/20; F05D 2260/83
USPC ..... 415/115
See application file for complete search history.

(56) References Cited

U.S. PATENT DOCUMENTS 6,485,255 B1 11/2002 Care et al.
6,981,845 B2 * 1/2006 Balland ..... F01D 5/081 416/248
7,021,892 B2 * 4/2006 Sidwell ..... F01D 5/18 29/889.2
9,051,838 B2 * 6/2015 Wardle ..... F01D 5/081
2010/0303610 A1 12/2010 Wang et al.
2013/0028727 A1 1/2013 Shinoda et al.
2015/0240649 A1 * 8/2015 Botrel ..... F01D 5/081 416/97 R
2017/0175534 A1 * 6/2017 Ferber ..... F01D 5/147

FOREIGN PATENT DOCUMENTS

WO 2014041311 A1 3/2014
WO 2014143236 A1 9/2014

OTHER PUBLICATIONS

EP Search Report dated Dec. 21, 2015, for EP patent application No. 15175475.1.
International Search Report dated Oct. 7, 2016, for PCT/EP2016/065954.

* cited by examiner

TURBINE STATOR VANE AND/OR TURBINE ROTOR VANE WITH A COOLING FLOW ADJUSTMENT FEATURE AND CORRESPONDING METHOD OF ADAPTING A VANE

CROSS REFERENCE TO RELATED APPLICATIONS

This application is the US National Stage of International Application No. PCT/EP2016/065954 filed Jul. 6, 2016, and claims the benefit thereof. The International Application claims the benefit of European Application No. EP15175475 filed Jul. 6, 2015. All of the applications are incorporated by reference herein in their entirety.

FIELD OF INVENTION

The invention relates to a cooling adjustment feature for turbine stator and/or rotor vanes, for example blades or vanes of a steam or gas turbine.

BACKGROUND OF INVENTION

Turbine vanes, such as turbine stator vanes or rotor vanes, the latter being also known as turbine blades, are subjected during operation in a gas or steam turbine to hot gas or steam. Thus, they need an active cooling, which is achieved by passing a cooling fluid such as air through internal passages of the vanes known as cooling channels.

The pressure drop and flow-rate of the cooling fluid is determined inter alia by the internal geometry of each vane and in particular of its cooling channels, and may vary depending on manufacturing tolerances affecting for example the cross-sectional areas of the cooling channels. Further, the same type of vane may be used in different types or versions of turbines, and further in different fields of operation, which may result in different firing temperatures and/or different life requirements. Thus, varying demands regarding the flow of the cooling fluid may exist.

In view of these varying requirements, the vanes are typically manufactured to match the highest cooling demands and/or worse-case manufacturing tolerances related to a desired cooling flow. For example, cross-sectional areas of the cooling channels are determined to be sufficiently large for guaranteeing a sufficient flow of cooling fluid even under the hottest firing temperatures to be expected. This, however, results in a loss of performance, since on the one hand cooling fluid and in particular cooling air mixes, when leaving the turbine vane, to the hot gas in the turbine and thus reduces its energy level. On the other hand, cooling air is drawn from the compressor, thereby reducing pressure and energy of the compressed air.

Accordingly, there is a need for providing turbine stator and/or rotor vanes having a better efficiency, improving the performance and power output of different types of turbines under varying, pre-specified conditions, while on the other hand meeting given life requirements.

SUMMARY OF INVENTION

These objects are solved by a turbine stator or rotor vane, a turbine including a turbine stator or rotor vane, a method of manufacturing a turbine stator or rotor vane and a method of adapting a turbine stator or rotor vane according to the independent claims. Further embodiments are described in the dependent claims.

A turbine stator vane or turbine rotor vane has a body, a channel being adapted for leading a cooling fluid through the body, and a flow adaption feature protruding from the body into the channel in such a manner as to reduce a cross-sectional area of the channel. The flow adaption feature is thus adapted for throttling a flow of the cooling fluid through the channel.

The term "vane" is used herein for turbine stator vanes and/or turbine rotor vanes. Further, turbine rotor vanes may also be referred to as blades in the following, as is common sometimes. It should be noted that the flow adaption feature is adapted for use in turbine stator and rotor vanes, i.e. turbine blades and vanes, and further adapted for use in any kind of turbine, such as a gas turbine, a steam turbine or the like.

The body of the vane may form a body of the vane, including for example its tip, blade, root platform and root, or parts of it. It may be formed by investment casting e.g. of an alloy material.

The cooling channel may be adapted, for example, to be used for air cooling or fluid cooling. It may lead through the body of the vane with any kind of geometry, and may be adapted for convection cooling, impingement cooling, film cooling and/or effusion cooling of the vane.

The flow adaption feature may protrude into the channel in a manner extending inwardly into the channel, thus reducing a cross-sectional area of the channel in a direction of the protrusion. It thus provides a means for metering the cooling fluid as it enters the vane, since reducing the cross-sectional area of the channel is smaller relative to the remainder of the channel. Thus, it forms a throttling means placed within the channel, the protrusions forming a throttle within the cooling channel.

The flow adaption feature may be arranged within the channel such that it determines a section of the channel having a minimum cross-sectional area. Thus, with the flow adaption feature, other sections of the channel do not affect the flow rate to an extent compromising the cooling capacity or overall efficiency of the vane. In particular, the flow adaption feature allows defining a target relation between fed pressure and flow rate and an effective area of the cooling channel.

By the flow adaption feature, a cooling capacity of the channel may for example be restricted to a pressure and flow rate just sufficing for cooling of the vane in an intended field of application. Thus, an excessive consumption of cooling fluid may be prevented.

If, however, a sufficient cooling flow through the vane cannot be achieved in a given application, it is possible to selectively remove a part of the material of the flow adaption feature, e.g. by reforming or reducing the protrusions, thereby enlarging the cross-sectional area of the channel. This removal may be performed in a well-directed manner for achieving e.g. a cross sectional opening of the channel admitting a predetermined necessary flow of the cooling fluid.

The removing part or all of the flow adaption feature may be performed for initially optimizing the vane's cooling fluid flow rate e.g. during a development process or as a manufacturing step to minimize scrap. For example, the protrusions may be reduced in a stepwise manner, for example in a calibration process of the vane. Thus, the stepwise removing may be continued until an intended cooling capacity of the channel is achieved.

Further, the removing operation may be performed during an optimization of an individual blade, e.g. for a use in a specific version of a turbine or in a particular field of application, e.g. at a predetermined firing temperature. Thus, each blade can be optimized individually in terms of flow and thermal requirements.

Still further, the vanes may also be individually optimized in terms of flow and thermal requirements within an engine test, e.g. when being mounted in a target turbine and being subjected to target conditions. Then, the flow and thermal conditions within the turbine may be monitored, and each of the vanes may be optimized for the intended use by means of the flow adaption feature, e.g. by removing the protrusions to an extent guaranteeing the required cooling with a minimum flow of cooling fluid.

Accordingly, the flow adaption feature allows optimizing on the one hand individual vanes and on the other hand a stage of a turbine or even the whole turbine for a particular application. Thereby, a high overall engine efficiency may be achieved while guaranteeing that each of the vanes is cooled in a sufficient manner.

During optimization, no additional parts are needed. Thus, additional costs only rise due to the removing operation, which may be performed by machining. The removing operation needs to only be performed on variants of the vanes which require tuning.

From a cost point of view there is a trade-off between the size of the blade and how far optimisation is driven in daily production. For smaller blades, it may be acceptable to use one size e.g. or the cross sectional area for all blades in the same application, e.g. firing temperature. For larger blades it may be advantageous to calibrate each and every blade individually. As a compromise, a few samples are taken from the batch delivered from the casting house or vane supplier and calibrated individually. The adjustment defined based on the sample result may then be used for all blades.

Thus, the flow of the cooling fluid can be specifically and precisely adapted to an intended use at low cost, thereby achieving a high engine overall efficiency while guaranteeing lifetime requirements. Accordingly, an overall engine cooling fluid usage is minimized and the overall engine efficiency is optimized.

In an embodiment of the vane, the channel has an inlet opening adapted for letting the cooling fluid enter the channel, and the flow adaption feature protrudes at the inlet opening so as to reduce the cross-sectional area of the inlet opening.

Thus, in the embodiment, the flow adaption feature is arranged at the inlet opening of the channel. For example, the inlet opening of the channel may perforate e.g. a root base of the root of the vane, and the protrusions may be formed as smooth extensions or prolongations of the root base extending so as to partially occlude the channel and in particular its inlet opening.

When being arranged at the inlet opening of the channel, the flow adaption feature can be easily reached for the removing or machining operation. Therefore, an optimization of the vane according to this embodiment may easily be performed.

In a further embodiment, the flow adaption feature is partially or entirely removable so as to enlarge the cross-sectional area of the channel.

Thus, the flow adaption feature and in particular its protrusions may be reshapeable, reducible, downsizeable or removable e.g. by a machining operation. This allows an easy adaption of the cross-sectional area at the inlet opening of the channel during optimization.

In a further embodiment, the flow adaption feature is an integral part of the body.

For example, the protrusions forming the flow adaption feature may be formed together with the body during a manufacturing process of the body, e.g. by investment casting the body using a shell exhibiting the flow adaption feature, e.g. leaving space for forming the flow adaption feature at the same time as the body from the alloy material. Thus, the flow adaption feature is provided at low cost, and further fixedly connected to or joined with the body.

In a further embodiment, the flow adaption feature is formed of a same material as the body. This allows an easy and robust joining or fixing of the flow adaption feature to the body of the vane.

In a method for adapting a turbine stator vane or turbine rotor vane, the vane has a body, a channel being adapted for leading a cooling fluid through the body, and a flow adaption feature protruding from the body to the channel in such a manner as to reduce a cross-sectional area of the channel. The method includes partly or entirely removing the flow adaption feature so as to enlarge the cross-sectional area of the inlet opening.

Thus, after the manufacturing of the vane, the method allows adapting the vane in view of the required flow of cooling fluid. In particular, the flow of cooling fluid may be adapted by purposefully and selectively enlarging the cross-sectional area of the inlet opening by removing at least parts of the flow adaption feature.

Accordingly, even from a series of essentially identical vanes, each vane may be adapted in view of its particular need for cooling e.g. at a certain position in a turbine, in a specified version of the turbine or in an intended field of application. In addition, each vane may be adapted depending on its coolant flow rate after initial manufacture tolerances and its target coolant flow rate. Thus, a low cost manufacturing of large series of vanes may be followed by an individual adaption of each vane in view of its intended application.

In a series of vanes, the cross-sectional area of the channel at the flow adaption feature e.g. within the protrusions may be determined such that it suits the vane with best expected thermal conditions, e.g. with the lowest need for cooling fluid. Thus, a small number of vanes which are intended to be used under the best expected thermal conditions will not require any adjustment or removing of the flow adaption feature, but may be used as manufactured. The other vanes, however, will be optimized by partly or entirely removing the flow adaption feature. This optimization, however, may be achieved at low cost e.g. by machining, and allows an accurate calibration of each vane.

In an embodiment of the method, a target cross-sectional area of the channel is determined in accordance with the cooling demand, wherein the removing at least a part of the flow adaption feature is performed such that the cross-sectional area of the inlet opening essentially corresponds to the target cross-sectional area of the channel or a target coolant flow rate.

For example, the cooling demand may be determined in view of an intended field of application, and expected firing temperature or a specific life requirement of turbine into which the vane is to be inserted. Thus, the method allows adapting the vane in accordance with the cooling demand. With the target cross-sectional area of the channel, it is possible to exactly determine e.g. the pressure of the cooling fluid at the inlet opening to achieve a required flow rate in accordance with a cooling demand. Thus, thermal conditions and life requirements are met while an engine overall efficiency is kept at an optimum.

It may be a desire to extend the life of a vane and this can be achieved by reducing the absolute temperature and/or temperature gradient of the vane during operation. Increasing the cooling fluid mass-flow rate by increasing the machining away of more of the flow adaption feature will enhance the coolant flow and reduce the absolute temperature and/or temperature gradient of the vane.

In a further embodiment, the method includes a calibration step comprising supplying the cooling fluid through the channel by varying a setting value, measuring an observation value (or an initial manufacturing value) and comparing the observation value to a target value of cooling fluid flow (e.g. the cooling fluid mass-flow rate). Within the method, the setting value may be a mass flow through the channel and the observation value may be a seed pressure at an inlet of the channel, or alternatively the setting value may be the seed pressure at the inlet. The observation value may be the mass flow through the channel.

Varying the setting value while observing the observation value provides a thorough understanding of the flow conditions within the vane. This allows building e.g. a correlation table that may be used during subsequent optimizations of other vanes.

In a further embodiment of the method, the steps of supplying the cooling fluid through the channel by varying the setting value, of measuring the observation value, of comparing the observation to the target value, and of partly or entirely removing the flow adaption feature so as to enlarge the cross-sectional area of the inlet opening are repeated until the observation value corresponds to the cooling demand.

Thus, an iterative adaption of the cross-sectional area of the channel allows precisely calibrating the vane in accordance with its need for cooling in an intended application.

In a further embodiment of the method, the vane may be mounted in a target turbine.

For example, at least during the supplying the cooling fluid through the channel by varying the setting value and during the measuring of the observation value and comparing the observation value to the target value, the vane may be mounted in the target turbine. Thus, the optimization may be closely tied to the later field of application, thus guaranteeing a precise optimization of the cooling flow.

Accordingly, an engine overall efficiency may be maximized while thermal requirements are met.

The described embodiments, together with the further advantages, will be best understood by reference to the following detailed description taken in conjunction with the accompanying drawings. The elements of the drawings do not necessarily scale relative to each other.

DETAILED DESCRIPTION OF INVENTION

Figure 1:
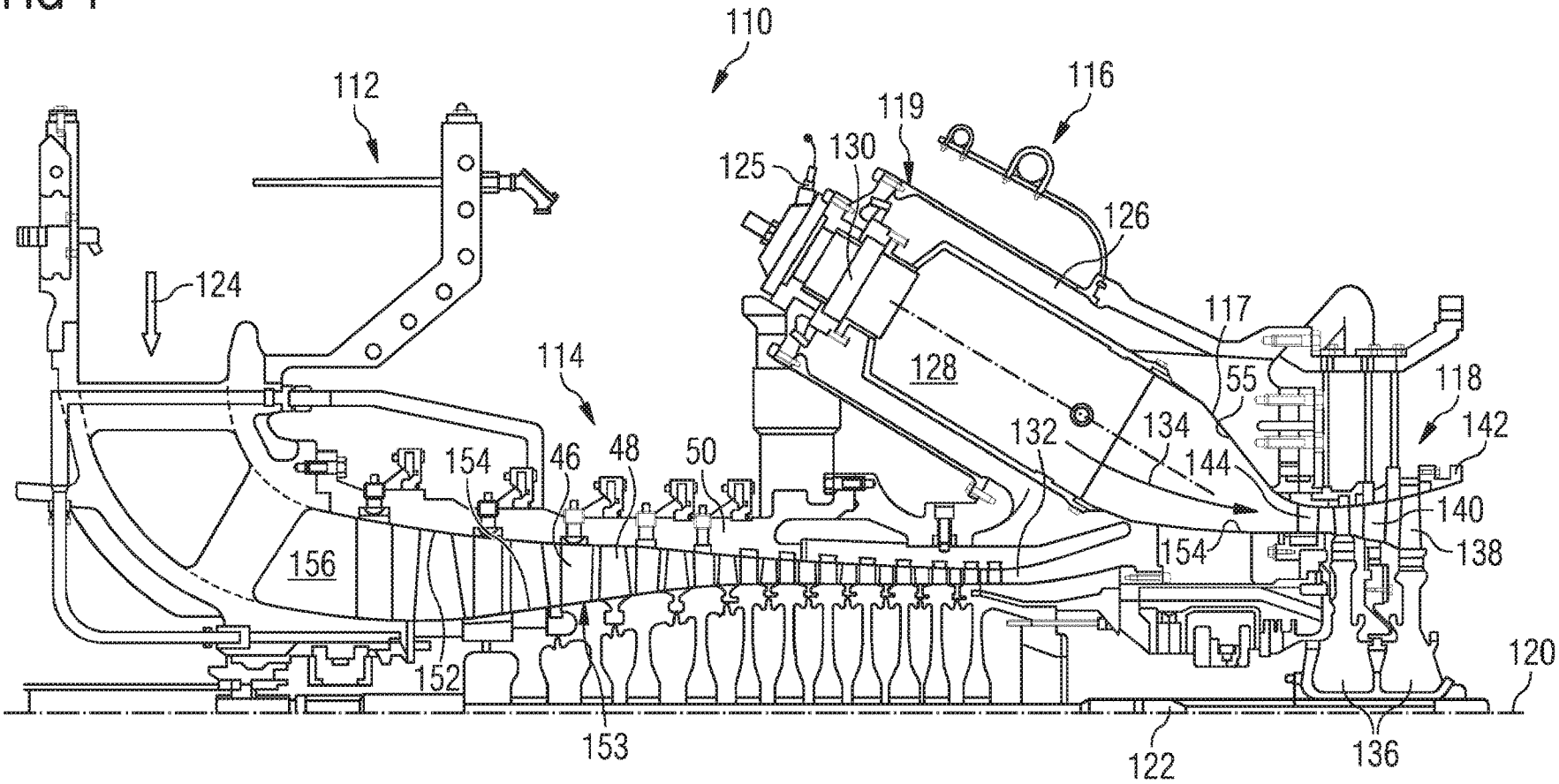
FIG. 1 shows part of a turbine engine in a sectional view and in which the present invention is incorporated.

Referring now to the drawings, wherein like reference numerals designate identical or corresponding parts throughout the several views.

FIG. 1 shows an example of a gas turbine engine 110 in a sectional view. The gas turbine engine 110 comprises, in flow series, an inlet 112, a compressor section 114, a combustor section 116 and a turbine section 118 which are generally arranged in flow series and generally about and in the direction of a longitudinal or rotational axis 120. The gas turbine engine 110 further comprises a shaft 122 which is rotatable about the rotational axis 120 and which extends longitudinally through the gas turbine engine 110. The shaft 122 drivingly connects the turbine section 118 to the compressor section 114.

In operation of the gas turbine engine 110, air 124, which is taken in through the air inlet 112 is compressed by the compressor section 114 and delivered to the combustion section or burner section 116. The burner section 116 comprises a burner plenum 126, one or more combustion chambers 128 and at least one burner 130 fixed to each combustion chamber 128. The combustion chambers 128 and the burners 130 are located inside the burner plenum 126. The compressed air passing through the compressor 114 enters a diffuser 132 and is discharged from the diffuser 132 into the burner plenum 126 from where a portion of the air enters the burner 130 and is mixed with a gaseous or liquid fuel. The air/fuel mixture is then burned and the combustion gas 134 or working gas from the combustion is channelled through the combustion chamber 128 to the turbine section 118 via a transition duct 117.

This exemplary gas turbine engine 110 has a cannular combustor section arrangement 116, which is constituted by an annular array of combustor cans 119 each having the burner 130 and the combustion chamber 128, the transition duct 117 has a generally circular inlet that interfaces with the combustion chamber 128 and an outlet in the form of an annular segment. An annular array of transition duct outlets form an annulus for channelling the combustion gases to the turbine section 118.

The turbine section 118 comprises a number of blade carrying discs 136 attached to the shaft 122. In the present example, two discs 136 each carry an annular array of turbine blades 138. However, the number of blade carrying discs could be different, i.e. only one disc or more than two discs. In addition, guiding vanes 140, which are fixed to a stator 142 of the gas turbine engine 110, are disposed between the stages of annular arrays of turbine blades 138. Between the exit of the combustion chamber 128 and the leading turbine blades 138 inlet guiding vanes 144 are provided and turn the flow of working gas onto the turbine blades 138.

The combustion gas from the combustion chamber 128 enters the turbine section 118 and drives the turbine blades 138 which in turn rotate the shaft 122. The guiding vanes 140, 144 serve to optimise the angle of the combustion or working gas on the turbine blades 138.

The turbine section 118 drives the compressor section 114. The compressor section 114 comprises an axial series of vane stages 46 and rotor blade stages 48. The rotor blade stages 48 comprise a rotor disc supporting an annular array of blades. The compressor section 114 also comprises a casing 50 that surrounds the rotor blade stages 48 and supports the vane stages 46. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 152 of the passage 156 of the compressor 114. A radially inner surface 154 of the passage 156 is at least partly defined by a rotor drum 153 of the rotor which is partly defined by the annular array of blades.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 120 of the engine.

Figure 2:
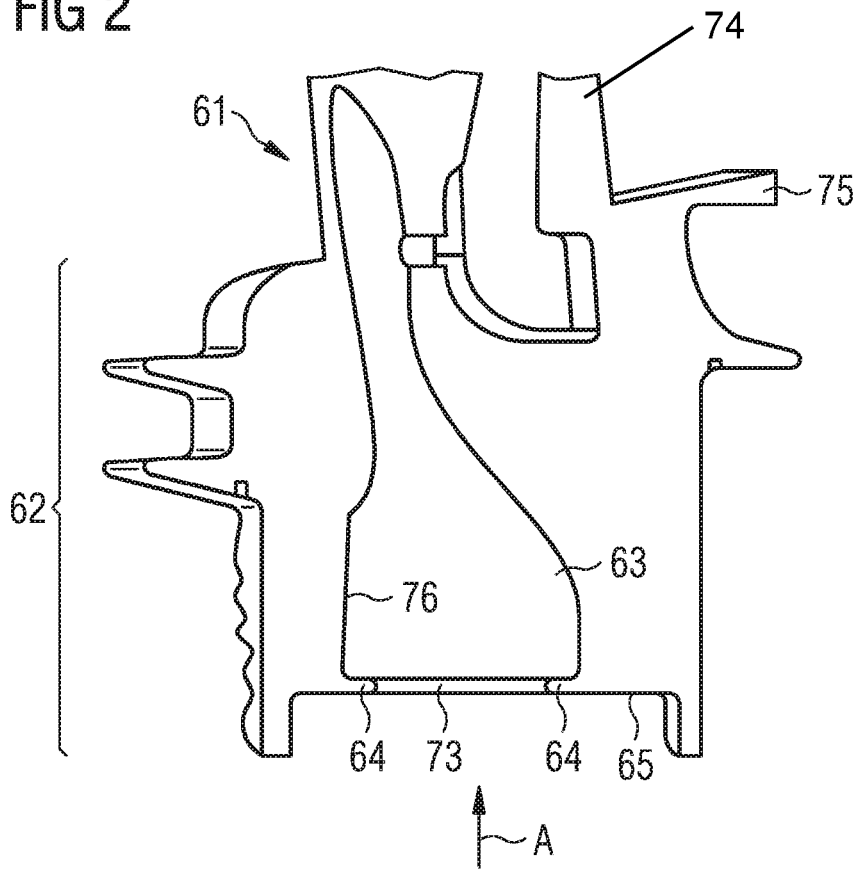
FIG. 2 illustrates a cross-sectional view of a lower part of a turbine rotor vane including a root part of the body at which flow adjustment features are formed.

FIG. 2 illustrates an embodiment of a turbine rotor vane or turbine stator vane, referred to as vane 61 and which may be any one or more of the vanes 144, 140 or blades 138 described with reference to FIG. 1. Vane 61 has a root part 62 and a body or aerofoil 74 through which a channel 63 for cooling vane 61 extends. From the root part 62, flow adaption features 64 protrude into the channel 63 in such a manner as to reduce a cross-sectional area of channel 63. In particular, the flow adaption feature(s) 64 protrude at an inlet opening 73 of channel 63 so as to reduce the cross-sectional area of the inlet opening 73. The protrusions 64 are formed as integral parts of the root part 62, enlarging a root base surface 65 of root part 62 in a direction occluding the inlet opening 73 of channel 63. The vane 61 has a platform 75 situated between the root part 62 and the aerofoil 74.

Due to the arrangement of the protrusions at the inlet opening 73 of channel 63, the flow adaption feature 64 is easily reachable for a calibration and machining of vane 61 by partly or entirely removing the flow adaption feature 64, e.g. by machining. Thus the flow adaption feature 64 allows an easy calibration of vane 61, in particular in view of a cooling demand e.g. in view of an intended firing or operating temperature, a type of turbine or field of application in which vane 61 is to be used. Thus, cooling fluid use is minimised and an engine's overall efficiency is maximized, while prescribed temperature conditions are met.

Figure 3:
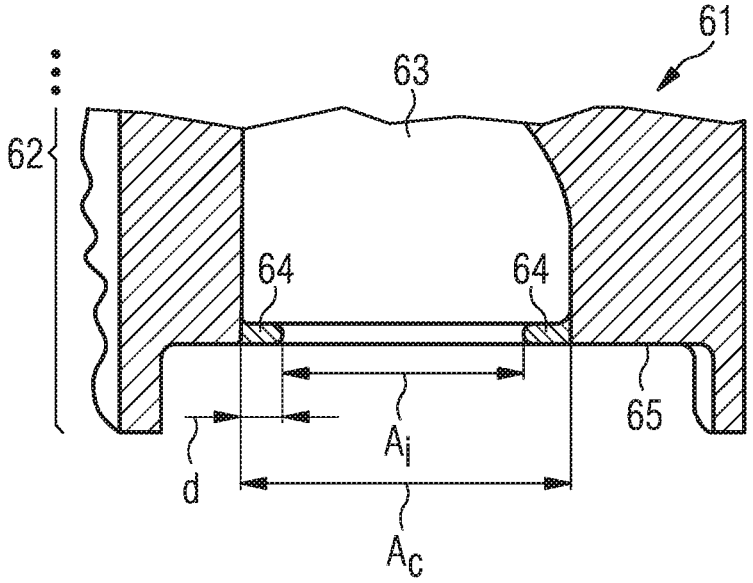
FIG. 3 illustrates a cross-sectional view of a lower part of a further embodiment of a turbine rotor vane with further flow adjustment features.

FIG. 3 illustrates a further embodiment of root part 62 of vane 61, wherein the flow adaption features 64 are formed of a material specifically adapted for a selective removal. Thus, vane 61 may be easily adapted in view of varying cooling demands. The flow adaption feature 64 is in the form of a disc having a generally rectangular cross-sectional shape as shown. Other cross-sectional shapes are possible. The radially outer edge or surface of the disc integrally blends into the channel walls 76 and the radially inner edge or surface defines the inlet opening 73 and its area Ai. The channel 63 has an area Ac such that complete removal of the flow adaption feature 64, Ac=Ai. The flow adaption feature 64 extends a distance d from the channel wall 76. In this embodiment the flow adaption feature 64 has an initially-manufactured constant extension d from the channel wall 76.

The term 'initially manufactured' means the cast shape of the vane or where other manufacturing methods are used such as laser sintering or laser deposition, it is the vane's shape formed by that process. It is possible that the 'initially-manufactured' form of the vane may comprise a dressing process to remove casting or laser forming irregularities or imperfections such as sharp edges, pips and dimples as known in the art. A plate welded on to the vane is a step after initial manufacturing. Similarly, in this context the term integral or integrally formed means that the flow adaption feature is formed during the initial manufacturing process and is part of the casting, sintering or laser deposition process of the vane.

The inlet opening 73 has an initial and nominal flow area Ai and which is less than a flow area for a first desired coolant mass flow. When designing the vane its cooling system, typically comprising cooling passages in the aerofoil and/or platform, is designed to transport a design or desired coolant mass flow to keep the vane's temperature to acceptable levels. However, for the present vane 61, the inlet opening 73 is initially manufactured with a smaller flow area Ai than a design or desired flow area and therefore all or a high percentage of all vanes will require the inlet opening 73 machining to increase its flow area to allow the design mass flow to pass into the vane. For a low percentage of initially manufactured vanes, manufacturing tolerances may mean that these few vanes will not require the inlet opening 73 machining.

In the present exemplary embodiment, the vane is initially manufactured such that the initial and nominal flow area Ai of the flow adaption feature 64 is between 75% and 98% of the flow area required for the first desired or design coolant mass flow. Thus, in nominal terms a high percentage, e.g. 98% of the vanes will have their inlet opening area increased before use. Not only does this ensure that the minimum amount of coolant is used, but also that the scrap rate of vanes is also reduced because initially manufactured vanes having worst-case tolerances can be remedied by significant increases in the inlet opening area Ai to increase coolant flow to the design mass flow rate or even higher to ensure all the vane is adequately cooled.

In a further embodiment, the cooling channel 63 is initially manufactured having a flow area Ac which is greater than the flow area for the first desired or design coolant mass flow. In particular the initially manufactured flow area Ac is between 105% and 200% the flow area for the first desired or design coolant mass flow. Thereby, the vane is capable of being used in second condition which can be either a hotter environment, such as a different gas turbine engine or an upgraded gas turbine engine, or where the life improvement is desired.

Yet further, in a circumstance where the life of the vane is limited by corrosion e.g. sulphate attack, then the mass coolant flow can be minimised such that the thermal degradation or thermal-life is also relaxed to the corrosion-life whereby the coolant mass flow is reduced from the coolant mass flow based on the vane's nominal thermal-life expectancy. In other words, the corrosion-life limited vane has less coolant and operates at a higher metal temperature. This reduces the thermal-life of the vane, but only to the extent of the corrosion life of the vane. In this case the initial manufacture of the flow adaption feature 64 has an initial and nominal inlet opening up to 50% of the design or desired area for a coolant mass flow of based on a nominal thermal-life.

Figure 4:
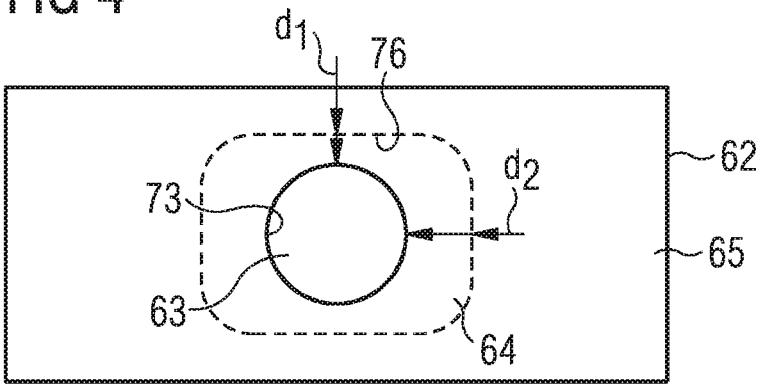
FIG. 4 illustrates a view on arrow A in FIG. 2 and shows the root base surface and extent of the flow adaption feature.

FIG. 4 is a view on arrow A in FIG. 2 and shows the root part's 62 base surface 65. The inlet opening 73 is shown here as a general oval shape, but could be any other shape. The flow adaption feature 64 has a constant extent d into the aperture formed by the inlet opening 73. The wall 76 of the cooling channel 63 is shown in dashed lines.

Figure 5:
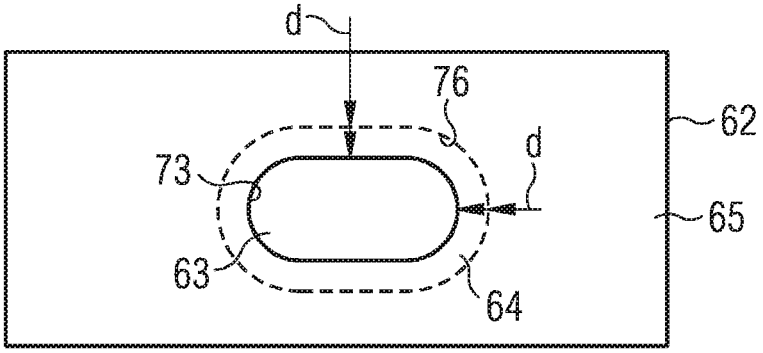
FIG. 5 illustrates a similar view on arrow A in FIG. 2, but instead shows a second embodiment of the flow adaption feature.

In FIG. 5 is a similar view to FIG. 4 and shows a third embodiment of the flow adaption feature 64. However, here the flow adaption feature 64 does not have a constant extent d into the cooling channel and forming the inlet opening 73. At the forward part or left hand side the flow adaption feature 64 has a greater extent d2 than elsewhere indicated by d1.

Figure 6:
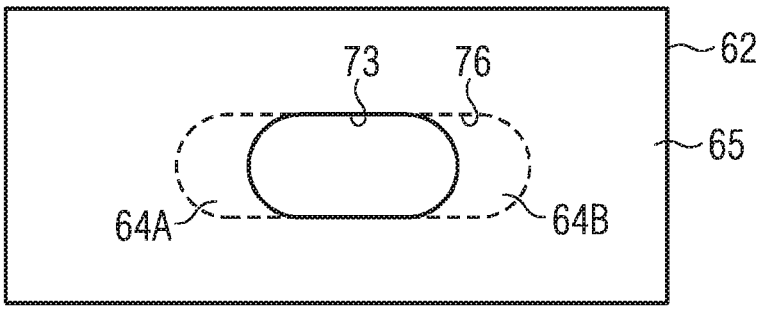
FIG. 6 illustrates a similar view on arrow A in FIG. 2, but instead shows a second embodiment of the flow adaption feature.

FIG. 6 is a similar view to FIG. 4 and shows a fourth embodiment of the flow adaption feature 64. However, the flow adaption feature 64 does not have a constant extent d into the aperture formed by the inlet opening 73. Instead there are two separate sections to the flow adaption feature indicated by 64*a* and 64*b*. Here the generally oval cooling channel 63 has an inlet opening 73 formed partly by the channel wall 76 itself and partly by the fore and aft flow adaption feature regions 64*a*, 64*b*. The fore flow adaption feature 64*a* is show on the left hand side of the figure. The fore and aft flow adaption features 64*a*, 64*b* need not be the same size and nor do they necessarily require the same machining when the inlet area Ai is increased.

Figure 7:
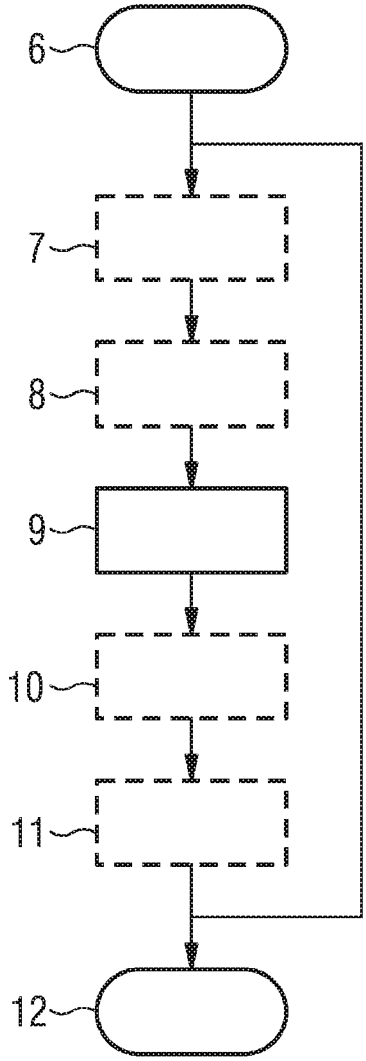
FIG. 7 illustrates an embodiment of a method for adapting a turbine stator vane or turbine rotor vane.

In FIG. 7, an embodiment of a method for adapting a vane, e.g. vane 61, is illustrated. The method has optional steps, illustrated by dashed rectangles, and a mandatory step, illustrated by a continuous rectangle.

After a beginning 6 of the method, a target turbine may be determined at 7 for vane 61, e.g. a turbine in which vane 61 is intended to be mounted. At 8, a target cross-sectional area of the channel may be determined in accordance with a cooling demand, which cooling demand may depend on a firing temperature of the target turbine, a life requirement of the vane or target turbine and/or on an intended field of application. At 9, the flow adaption feature 64 is partly or entirely removed so as to enlarge the cross-sectional area of the inlet opening of cooling channel 63. In particular, the removing may be performed such that the cross-sectional area of the inlet opening of channel 63 may essentially correspond to the target cross-sectional area of channel 63 as determined at 8. At 10, vane 61 may be mounted in the target turbine as determined at 7. At 11, a cooling fluid may be supplied through cooling channel 63 e.g. by varying a setting value. Further, an observation value may be measured and compared to a target value. Depending on a result of the comparison, the method may end at 12 if a sufficient calibration of vane 61 has been achieved, or may be continued e.g. by repeating steps 7 to 11.

Steps 7 to 11 may be repeated until the observation value corresponds to a cooling demand. Thereby, an accurate adaption may be achieved, allowing to exactly determine the cooling flow for an intended application.

In another embodiment of the present method of manufacturing the vane 61, the inlet opening 73 is formed having an initial and nominal flow area Ai and that is less than a flow area for first desired coolant mass flow. The vane is then tested for its mass flow rate of coolant passing through the cooling channel 63 to find an actual mass flow. From a calibration relationship, fluid flow theory or by retesting an increase in area of the flow adaption feature 64 is determined to achieve the desired coolant mass flow. The flow adaption feature 64 is then machined to increase the inlet opening 73 area to achieve the desired or design mass flow. The design mass flow may be based on achieving a certain initial thermal life of the vane or a second thermal life of the vane. In summary, the vane has a nominal thermal-life greater than a nominal corrosion-life, the nominal thermal-life having the flow area for first desired coolant mass flow, thus the method comprises the step of forming the initial and nominal area Ai of the inlet opening between 90% and 50% of the flow area for first desired coolant mass flow. Therefore, it is possible to operate the vane with only 50% of the coolant flow to limit the thermal life to that of the corrosion life. This can save a substantial amount of parasitic coolant that would otherwise be bled from a compressor.

As mentioned before, the determining step comprises calibrating at least one vane 61 to find a relationship between the area of the inlet opening 73 and a setting value. This can be done of a vane-by-vane basis or on a batch of vanes and by statistical analysis with a high confidence limit of say 95%. Calibration can be done by supplying 10 the coolant through the channel 63 by varying a setting value, and measuring 11 an observation value and comparing the observation value to a target value. The setting value is a mass flow through the channel 63 or a seed pressure at the inlet of the channel 63. The observation value is a seed pressure at the inlet of the channel 63 or the mass flow through the channel 63.

Repeating the method steps of supplying, measuring and removing until the observation value corresponds to the desired coolant mass flow gives the greatest accuracy. However, this is advantageously conducted for the calibration phase for each different design mass coolant flow or for occasional quality testing.

A first desired coolant mass flow of a vane 61 is that suitable for a first operating condition and which could be for a base engine design. However, alternatively, the desired coolant mass flow can be a second desired coolant mass flow of a vane 61 suitable for a second operating condition which is at higher or longer operating level than the first operating level.

As mentioned, the method is extended to manufacturing a vane assembly such as an array of stator vanes or a rotor stage of the turbine. Each vane of the plurality of vanes 61 is initially manufactured as described above except that the desired coolant mass flow is that of an average mass flow per vane 61 of the desired coolant mass flow of the plurality of vanes 61.

Thus, a selective calibration of vane 61 in view of its cooling demand and cooling fluid consumption in its intended use in the target turbine and target field of application is achieved, minimizing a cooling fluid consumption while optimizing an overall efficiency.

The embodiments of the present vane and its method of manufacture enable precise metering of coolant into each vane by virtue of machining the flow adaption feature. Vanes may be tested and calibrated individually to identify the amount of machining required to meet the desired coolant flow. Alternatively, an array of vanes may be tested and calibrated to identify an average machining requirement to meet the desired coolant flow for that array. Not only can the present vane and its method of manufacture be applied to an originally intended first engine application, but also a second engine application which operates at a higher turbine temperature. Here in-service vanes can be reworked or new vanes can be adjusted by further machining of the flow adaption feature to allow yet more coolant into the vane. Similarly, where in-service blades or new blades are required to have an increase in life, the vane can be remedied by further machining of the flow adaption feature to allow yet more coolant into the vane thereby reducing metal temperatures and thermal stresses. The present vane and its method of manufacture are also suited to yet further optimisation of coolant use. Where a vane's life is limited by corrosion for example its thermal life can also be reduced accordingly to that of the corrosion-life thus saving coolant and increasing overall efficiency. Here the flow adjustment feature has none or minimal machining.

The invention claimed is:

1. A method of manufacturing a vane, the vane comprising a root part, an aerofoil and a cooling channel extending through at least the root part, the cooling channel is defined by a wall and comprises a flow adaption feature, the method comprising:

determining a first desired coolant mass flow for the cooling channel that is suitable for operation of the vane at a first operating level in a gas turbine engine, determining an oversized flow area of the cooling channel that is 105% to 200% greater than a flow area of the cooling channel required to achieve the first desired coolant mass flow, forming the vane comprising the cooling channel comprising the oversized flow area and comprising the flow adaption feature as an inlet of the cooling channel, wherein the inlet is disposed within the root part, and wherein the flow adaption feature partly occludes an inlet opening of the cooling channel to an initial and nominal flow area (Ai) which is less than the flow area of the cooling channel required to achieve the first desired coolant mass flow, testing a mass flow rate of coolant passing through the cooling channel to find an actual mass flow, determining an increase in area of the flow adaption feature needed to achieve the first desired coolant mass flow based on the actual mass flow, and machining the flow adaption feature to increase the inlet opening to achieve the first desired coolant mass flow.

2. The method of manufacturing a vane as claimed in claim 1, wherein the initial and nominal flow area (Ai) of the flow adaption feature is between 75% and 98% of the flow area required to achieve the first desired coolant mass flow.

3. The method of manufacturing a vane as claimed claim 1, wherein the determining step comprises calibrating the vane to find a relationship between the initial and nominal flow area (Ai) of the inlet opening and a setting value, by supplying coolant through the cooling channel by varying the setting value, and measuring an observation value and comparing the observation value to a target value, wherein the setting value is a mass flow through the cooling channel and the observation value is a seed pressure at the inlet opening of the cooling channel or the setting value is the seed pressure at the inlet opening of the cooling channel and the observation value is the mass flow through the cooling channel.

4. The method of manufacturing a vane as claimed in claim 1, further comprising:

wherein the determining step comprises calibrating the vane to find a relationship between the initial and nominal flow area (Ai) of the inlet opening and a setting value, by supplying coolant through the cooling channel by varying the setting value, measuring an observation value and comparing the observation value to a target value, removing part or all of the flow adaption feature so as to enlarge a cross-sectional area of the inlet opening, and repeating the steps until the observation value corresponds to the first desired coolant mass flow, wherein the setting value is a mass flow through the cooling channel and the observation value is a seed pressure at the inlet opening of the cooling channel or the setting value is the seed pressure at the inlet opening of the cooling channel and the observation value is the mass flow through the cooling channel.

5. The method of manufacturing a vane as claimed in claim 1, wherein the vane comprises a nominal thermal-life greater than a nominal corrosion-life, the nominal thermal-life comprising the flow area required to achieve the first desired coolant mass flow, the method further comprising:

forming the initial and nominal area (Ai) of the inlet opening between 50% and 90% of the flow area required to achieve the first desired coolant mass flow.

6. A vane for a gas turbine engine, the vane comprising:

a root part, an aerofoil, and a cooling channel extending through at least the root part, wherein the cooling channel is defined by a wall and comprises a flow area that is 105% to 200% greater than a flow area required to achieve a first desired coolant mass flow and a flow adaption feature as an inlet of the cooling channel, wherein the inlet is disposed within the root part, and wherein the flow adaption feature partly occludes an inlet opening of the cooling channel to an initial and nominal flow area (Ai) and which is less the flow area required to achieve a first desired coolant mass flow in the cooling channel that is suitable for operation of the vane in the gas turbine engine.

7. The vane as claimed in claim 6, wherein the initial and nominal flow area (Ai) of the flow adaption feature is between 75% and 98% of the flow area required to achieve the first desired coolant mass flow.

8. The vane as claimed in claim 6, further comprising:

a platform between the root part and the aerofoil, wherein the platform and/or the aerofoil comprise cooling passages which extend from the cooling channel.

9. The vane as claimed in claim 6, wherein the root part comprises a root base surface and the inlet opening is formed in the root base surface.

10. The vane as claimed in claim 6, wherein the flow adaption feature is integrally formed with the vane during initial casting, sintering or deposition forming.

11. The vane as claimed in claim 9, wherein the root base surface comprises a radially inward root base surface.

12. The method of manufacturing a vane as claimed in claim 1, wherein the first operating level is at least base engine design.

13. A method of manufacturing a vane assembly comprising a plurality of vanes, each vane comprising a root part, an aerofoil and a cooling channel extending through at least the root part, wherein the cooling channel is defined by a wall and comprises a flow adaption feature, the method comprising:

determining an average first desired coolant mass flow for each vane of the plurality of vanes that is suitable for operation of the plurality of vanes at a first operating level in a gas turbine engine, determining for each vane an oversized flow area of the cooling channel that is 105% to 200% greater than a flow area of the cooling channel required to achieve the average first desired coolant mass flow, forming each vane comprising the cooling channel comprising the oversized flow area and comprising the flow adaption feature as an inlet of the cooling channel, wherein the inlet is disposed within the root part, and, wherein the flow adaption feature partly occludes an inlet opening of the cooling channel to an initial and nominal flow area (Ai) which is less than the flow area of the cooling channel required to achieve the average first desired coolant mass flow, testing a mass flow rate of coolant passing through the plurality of vanes to find an actual mass flow, determining an average machining requirement of each flow adaption feature needed to achieve the average first desired coolant mass flow based on the actual mass flow, and machining each flow adaption feature to increase the inlet opening to achieve the average first desired coolant mass flow.

* * * * *